US005681403A

United States Patent [19]

Makino et al.

[11] Patent Number: 5,681,403

[45] Date of Patent: Oct. 28, 1997

[54] MAGNESIUM ALLOY

[75] Inventors: Kunihiko Makino; Toshiro Kawata; Kyosuke Kanemitsu, all of Ube; Koji Watanabe, Yokohama; Masaji Matsunaga, Tatebayashi; Mamoru Sayashi, Miura, all of Japan

[73] Assignees: Nissan Motor Co., Ltd., Yokohama; Ube Industries, Ltd., Ube, both of Japan

[21] Appl. No.: 364,050

[22] Filed: Dec. 27, 1994

[51] Int. Cl.[6] ..... C22C 23/00

[52] U.S. Cl. ..... 148/420; 420/405; 420/407; 420/408; 420/411

[58] Field of Search ..... 148/420; 420/405, 420/407, 408, 411

[56] References Cited

U.S. PATENT DOCUMENTS

| | | | |
|---|---|---|---|
| 3,496,035 | 2/1970 | Foerster | 148/420 |
| 5,073,207 | 12/1991 | Faure et al. | 148/2 |
| 5,304,260 | 4/1994 | Aikawa et al. | 420/405 |

FOREIGN PATENT DOCUMENTS

| | | | |
|---|---|---|---|
| 0414620 | 2/1991 | European Pat. Off. . | |
| 0419375 | 3/1991 | European Pat. Off. . | |
| 690785 | 4/1953 | United Kingdom . | |
| 907404 | 10/1962 | United Kingdom | 148/420 |
| 1162283 | 8/1969 | United Kingdom | 420/405 |
| 1163200 | 9/1969 | United Kingdom . | |
| 1196767 | 7/1970 | United Kingdom . | |
| 1427602 | 3/1976 | United Kingdom . | |
| 89/08154 | 9/1989 | WIPO . | |

*Primary Examiner*—John Sheehan
*Attorney, Agent, or Firm*—Foley & Lardner

[57] ABSTRACT

A magnesium Mg—Al—RE magnesium alloy wherein an amount of a rare earth component may be reduced while optimial tensile strength and durability are obtained. The Alloy further includes a small calcium component. A high degree of creep resistance is obtained. Further, additional copper and/or zinc components may be introduced together, or singly for providing favorable tensile characteristics to the alloy material.

20 Claims, 4 Drawing Sheets

MAGNESIUM ALLOY

BACKGROUND OF THE INVENTION

1. Field of The Invention

The present invention relates generally to a magnesium alloy for industrial use.

2. Description of The Related Art

Metallic alloys utilizing magnesium are widely used for automotive, electronic, aerospace and various industrial applications. Particularly, such alloys are favorable which have a high temperature 'creep' strength and which may be utilized in high-temperature environments.

Various magnesium alloys have been developed and registered such as JIS H 5203 (MC1–MC10) or JIS H 5303 magnesium alloys (MDC1A, MDC1B). For high temperature environments, AE42 having Mg-4%Al-2%RE developed by Dow Chemical is well known.

Such a heat-resistant magnesium alloy, it is difficult to utilize in die casting where fast cooling is employed after molding of a metal article.

Further, a rare earth (hereinbelow: RE) component included in such alloys increases costs and high temperature creep resistance is reduced.

SUMMARY OF THE INVENTION

It is therefore a principal object of the present invention to overcome the drawbacks of the related art.

It is a further object of the present invention to provide a Mg—Al—RE magnesium alloy wherein RE is reduced while a small Ca component is introduced, while retaining a high degree of creep resistance and favorable bending characteristics.

In order to accomplish the aforementioned and other objects, there is provided a magnesium containing metallic alloy material, comrpising: an aluminium (Al) component contained in a range of 1.5–10% by weight; a rare earth (RE) component contained in a range of less than 2% by weight; a calcium (Ca) component contained in a range of 0.25–5.54 by weight; and wherein the remainder of the alloy is comprised of magnesium (Mg).

DESCRIPTION OF THE PREFERRED EMBODIMENT

Figure 1:
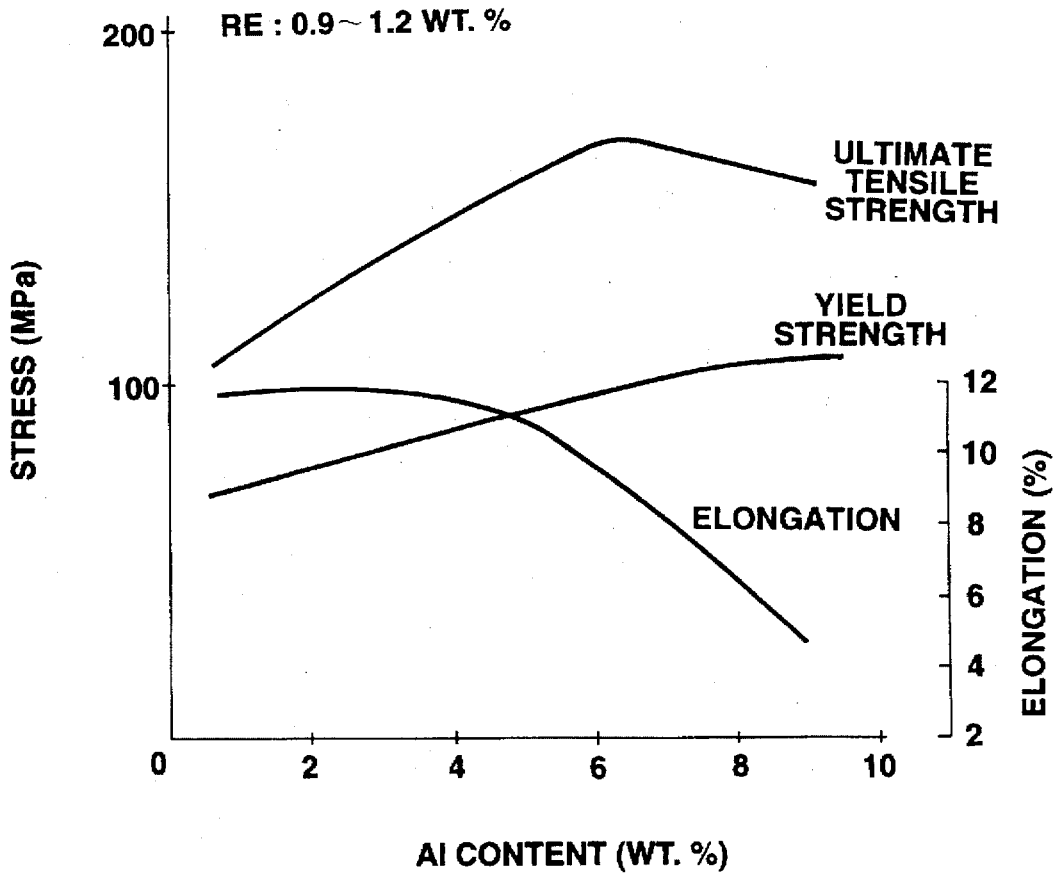
FIG. 1 is a stress graph showing ultimate tensile strength, yield strength and elongation in relation to Al—RE content.
Figure 2:
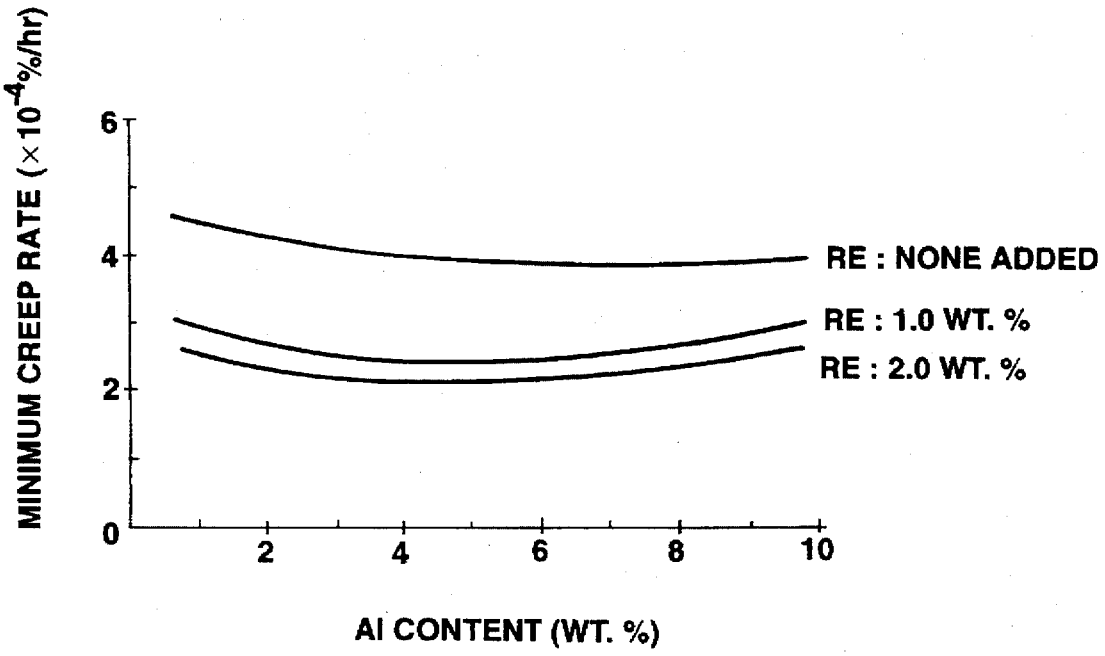
FIG. 2 is a graph illustrating minimum creep rate in relation to Al content for alloys having various levels of RE content.
Figure 3:
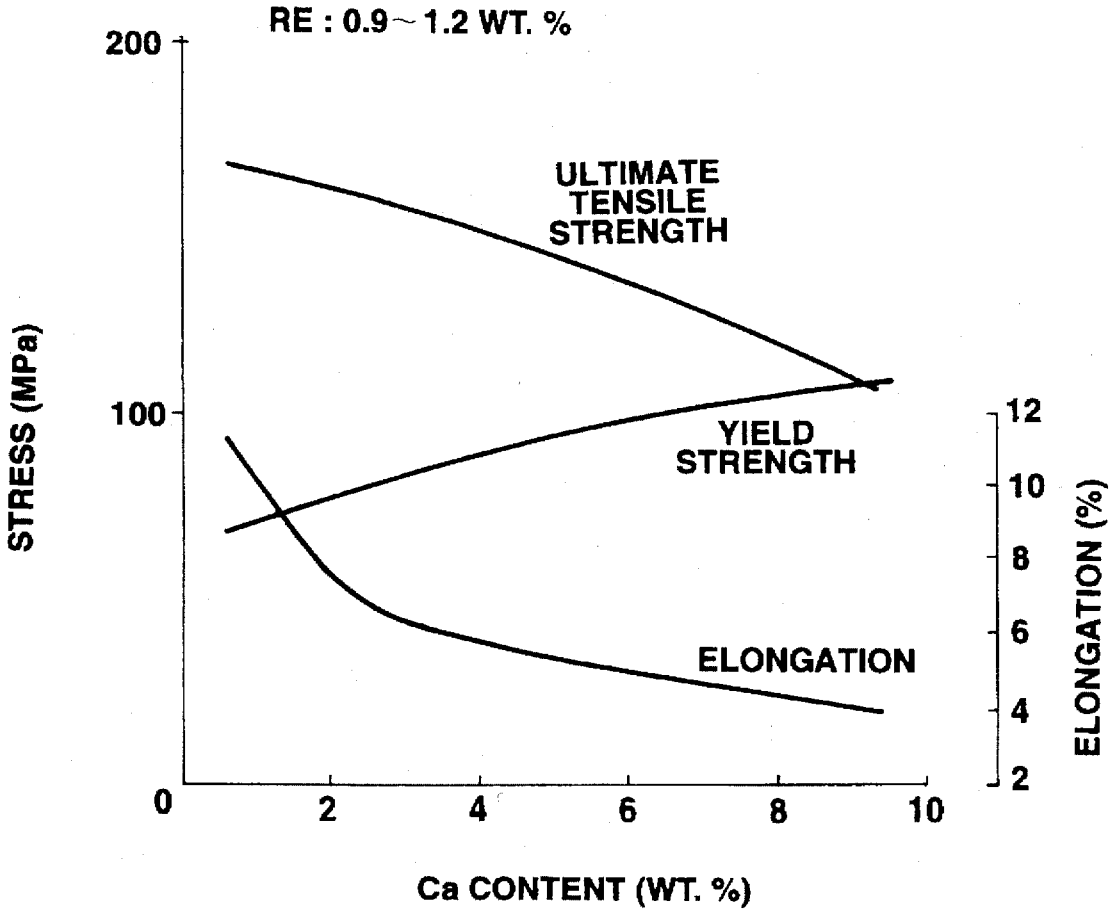
FIG. 3 is a graph comparing stress and Ca content in relation to various characteristics in alloys containing RE in a given range.
Figure 4:
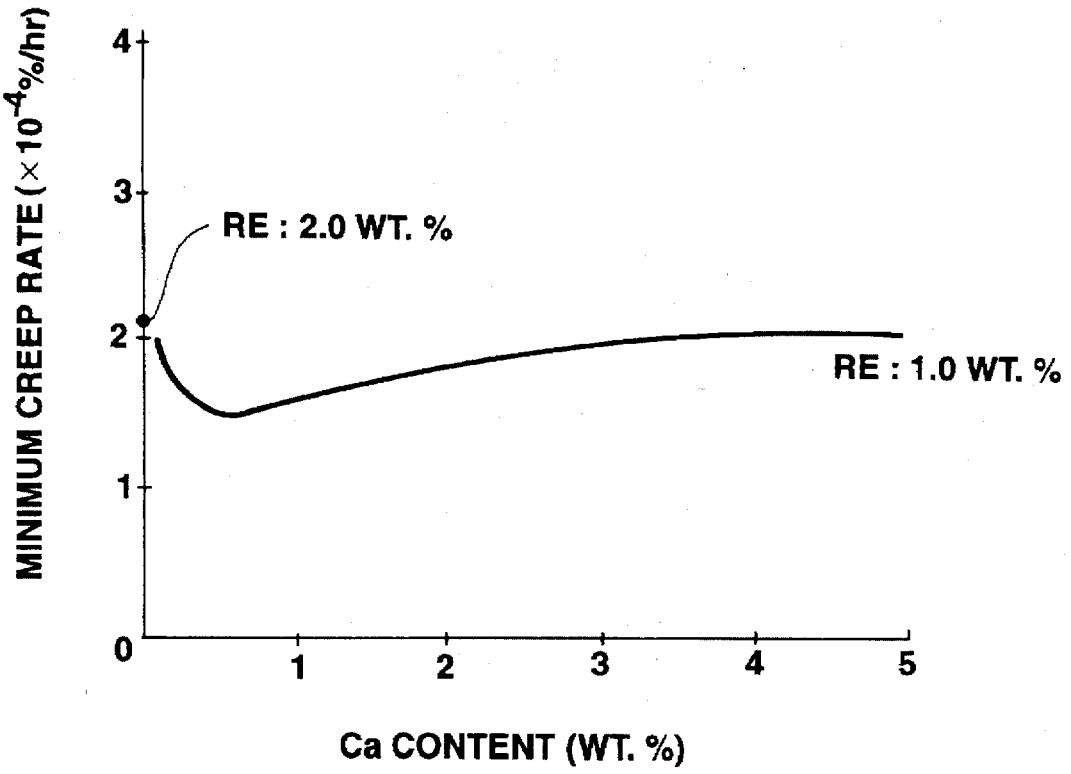
FIG. 4 is a graph showing minimum creep rate characteristics in Ca containing alloys in relation to a given amount of RE contained in the alloy.

Referring to the accompanying drawings, a preferred embodiment of the invention will be described hereinbelow in detail.

The present invention seeks to provide a Mg—Al—RE magnesium alloy wherein RE is reduced while a small Ca component is introduced, while retaining a high degree of creep resistance. According to the inention, additional Cu, Zn components may be introduced together, or singly for providing favorable bending characteristics to the alloy material.

Various alloys have been formed according to generally known melting technique in a steel crucible having a nickel (Ni) component removed therefrom in an ambient atmosphere comprised of a gas such as $SF_6$, $CO_2$ or air.

Referring to Table 1, thirty-eight alloys have been utilized including nineteen embodiments of the alloy of the invention developed by the inventors through experimentation, and nineteen samples for comparision, including the above mentioned conventional alloy. The pieces were tested for various characteristics such as ultimate tensile strength, yield strength, elongation and minimum creep rate. Table 2 shows the effects of the various alloy compositions:

TABLE 1

| SAMPLE | CHEMICAL COMPONENTS BY WEIGHT % | | | | | | | COM- |
|---|---|---|---|---|---|---|---|---|
| TYPE | Al | Mn | RE | Ca | Cu | Zn | Mg | MENTS |
| COMPARISON 1 | 2.0 | 0.39 | — | — | — | — | REMAINDER | |
| COMPARISON 2 | 4.1 | 0.29 | — | — | — | — | REMAINDER | |
| COMPARISON 3 | 9.5 | 0.25 | — | — | — | — | REMAINDER | |
| COMPARISON 4 | 2.1 | 0.38 | 0.49 | — | — | — | REMAINDER | |
| COMPARISON 5 | 3.9 | 0.28 | 0.51 | — | — | — | REMAINDER | |
| COMPARISON 6 | 1.9 | 0.41 | 1.1 | — | — | — | REMAINDER | |
| COMPARISON 7 | 4.1 | 0.31 | 1.2 | — | — | — | REMAINDER | |
| COMPARISON 8 | 2.0 | 0.41 | 2.1 | — | — | — | REMAINDER | |
| EMBODIMENT 1 | 2.0 | 0.38 | 0.90 | 0.32 | — | — | REMAINDER | |
| EMBODIMENT 2 | 4.1 | 0.29 | 1.1 | 0.31 | — | — | REMAINDER | |
| EMBODIMENT 3 | 5.9 | 0.32 | 1.2 | 0.30 | — | — | REMAINDER | |
| EMBODIMENT 4 | 9.4 | 0.25 | 1.0 | 0.29 | — | — | REMAINDER | |
| EMBODIMENT 5 | 1.9 | 0.39 | 0.90 | 1.0 | — | — | REMAINDER | |
| EBMODIMENT 6 | 4.0 | 0.35 | 1.1 | 0.90 | — | — | REMAINDER | |
| EMBODIMENT 7 | 6.1 | 0.32 | 1.2 | 1.1 | — | — | REMAINDER | |
| EMBODIMENT 8 | 9.5 | 0.26 | 1.1 | 1.0 | — | — | REMAINDER | |
| EMBODIMENT 9 | 2.0 | 0.42 | 0.90 | 3.0 | — | — | REMAINDER | |
| EMBODIMENT 10 | 4.2 | 0.35 | 0.90 | 3.1 | — | — | REMAINDER | |
| EMBODIMENT 11 | 5.9 | 0.31 | 1.1 | 3.2 | — | — | REMAINDER | |
| EMBODIMENT 12 | 9.3 | 0.28 | 1.0 | 3.0 | — | — | REMAINDER | |
| COMPARISON 9 | 0.5 | 0.40 | — | — | — | — | REMAINDER | |
| COMPARISON 10 | 1.1 | 0.42 | — | — | — | — | REMAINDER | |
| COMPARISON 11 | 0.4 | 0.42 | 1.0 | 0.25 | — | — | REMAINDER | |
| COMPARISON 12 | 0.5 | 0.42 | 1.1 | 1.1 | — | — | REMAINDER | |
| COMPARISON 13 | 0.5 | 0.38 | 1.0 | 3.1 | — | — | REMAINDER | |
| COMPARISON 14 | 0.4 | 0.39 | 1.2 | 5.1 | — | — | REMAINDER | |
| EMBODIMENT 13 | 1.9 | 0.36 | 0.90 | 5.0 | — | — | REMAINDER | |

TABLE 1-continued

| SAMPLE TYPE | CHEMICAL COMPONENTS BY WEIGHT % Al | Mn | RE | Ca | Cu | Zn | Mg | COMMENTS |
|---|---|---|---|---|---|---|---|---|
| EMBODIMENT 14 | 4.0 | 0.38 | 1.1 | 4.9 | — | — | REMAINDER | |
| EMBODIMENT 15 | 5.8 | 0.29 | 1.2 | 5.1 | — | — | REMAINDER | |
| EMBODIMENT 16 | 9.5 | 0.27 | 1.0 | 5.0 | — | — | REMAINDER | |
| COMPARISON 15 | 4.0 | 0.33 | 1.9 | — | — | — | REMAINDER | AE42 Alloy |
| COMPARISON 16 | 3.9 | 0.34 | 2.3 | 0.25 | — | — | REMAINDER | |
| COMPARISON 17 | 4.0 | 0.35 | 2.4 | 1.1 | — | — | REMAINDER | |
| COMPARISON 18 | 4.1 | 0.32 | 2.3 | 3.1 | — | — | REMAINDER | |
| COMPARISON 19 | 4.0 | 0.33 | 2.3 | 5.1 | — | — | REMAINDER | |
| EMBODIMENT 17 | 4.0 | 0.34 | 1.1 | 0.2 | 0.5 | — | REMAINDER | |
| EMBODIMENT 18 | 4.0 | 0.34 | 1.1 | 0.5 | — | 2.0 | REMAINDER | |
| EMBODIMENT 19 | 4.1 | 0.32 | 1.2 | 0.2 | 0.5 | 0.5 | REMINDER | |

TABLE 2

| SAMPLE TYPE | BENDING STRENGTH (MPa) | DURABILITY (MPa) | STRETCH (%) | SMALLEST CREEP SPEED ($10^4$ % hr.) |
|---|---|---|---|---|
| COMPARISON 1 | 75 | 38 | 9.2 | 5.95 |
| COMPARISON 2 | 90 | 56 | 12.3 | 5.85 |
| COMPARISON 3 | 115 | 72 | 10.5 | 5.82 |
| COMPARISON 4 | 123 | 58 | 8.5 | 4.76 |
| COMPARISON 5 | 143 | 85 | 11.3 | 4.63 |
| COMPARISON 6 | 121 | 81 | 12.0 | 4.42 |
| COMPARISON 7 | 125 | 92 | 11.6 | 4.15 |
| COMPARISON 8 | 110 | 80 | 8.5 | 2.3 |
| EMBODIMENT 1 | 160 | 65 | 13.1 | 1.63 |
| EMBODIMENT 2 | 169 | 110 | 12.3 | 1.55 |
| EMBODIMENT 3 | 195 | 84 | 13.2 | 1.95 |
| EMBODIMENT 4 | 168 | 108 | 15.0 | 2.36 |
| EMBODIMENT 5 | 135 | 65 | 8.5 | 2.26 |
| EMBODIMENT 6 | 171 | 68 | 9.9 | 1.62 |
| EMBODIMENT 7 | 162 | 59 | 10.5 | 1.79 |
| EMBODIMENT 8 | 123 | 48 | 11.2 | 1.89 |
| EMBODIMENT 9 | 128 | 116 | 4.2 | 1.75 |
| EMBODIMENT 10 | 159 | 81 | 5.9 | 1.89 |
| EMBODIMENT 11 | 156 | 92 | 4.5 | 1.72 |
| EMBODIMENT 12 | 150 | 110 | 2.9 | 1.94 |
| COMPARISON 9 | 83 | 41 | 18.0 | 6.57 |
| COMPARISON 10 | 92 | 47 | 17.2 | 6.42 |
| COMPARISON 11 | 110 | 105 | 1.2 | 4.95 |
| COMPARISON 12 | 113 | 107 | 1.1 | 4.83 |
| COMPARISON 13 | 124 | 111 | <1.0 | 4.80 |
| COMPARISON 14 | 131 | 115 | <1.0 | 4.72 |
| EMBODIMENT 13 | 135 | 111 | 3.4 | 1.95 |
| EMBODIMENT 14 | 146 | 91 | 5.2 | 2.03 |
| EMBODIMENT 15 | 129 | 92 | 4.4 | 1.67 |
| EMBODIMENT 16 | 160 | 112 | 3.0 | 1.94 |
| COMPARISON 15 | 165 | 75 | 14.0 | 2.51 |
| COMPARISON 16 | 167 | 79 | 13.7 | 2.49 |
| COMPARISON 17 | 169 | 85 | 11.0 | 2.45 |
| COMPARISON 18 | 171 | 86 | 7.5 | 2.32 |
| COMPARISON 19 | 171 | 86 | 4.2 | 2.21 |
| EMBODIMENT 17 | 190 | 76 | 11.9 | 2.19 |
| EMBODIMENT 18 | 205 | 86 | 12.9 | 2.05 |
| EMBODIMENT 19 | 195 | 78 | 11.4 | 2.13 |

As may be seen from the Tables, embodiments 1–12 have favorable mechanical characteristics while RE is reduced compared with AE42 or the like, and high temperature creep strength is advantageously retained. Moreover, embodiments 13–15 include a Cu and/or Zn component having ultimate tensile strength of about 200 MPa and yeild strength of about 80 MPa. Also, a minimum creep rate of $2.0\times10^{-4}$%/hr is obtained, while uniform temperature tensile characteristics are highly favorable.

It will be noted that high temperature creep strength is improved in comparison with AE42 and the other comparative examples, as shown in the tables.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A magnesium containing metallic alloy, comprising:

an aluminum (Al) component contained in a range of 1.5–10% by weight;

a rare earth (RE) component contained in a range of less than 2% by weight;

a calcium (Ca) component contained in a range of 0.25–5.5% by weight; and from 77.5 to 98.25% by weight of magnesium (Mg), wherein said alloy has a creep rate within the range of 1.55 and $2.36\times10^{-4}$/hr.

2. An alloy material as claimed in claim 1, further comprising at least one of a copper (Cu) component and a zinc (Zn) component each in a range of 0.2–2.5% by weight.

3. An alloy material as claimed in claim 1, wherein said alloy has an elongation within the range of 2.9 and 15%.

4. An alloy material as claimed in claim 3, further comprising at least one of copper and zinc each in a range of 0.2 to 2.5 wt%.

5. An alloy material as claimed in claim 1, wherein said alloy has a tensile strength within the range of 123–205 MPa.

6. An alloy material as claimed in claim 1, wherein said alloy has a yield strength within the range of 48–116 MPa.

7. An alloy material as claimed in claim 1, wherein said alloy has an elongation within the range of 2.9 and 15%, a tensile strength within the range of 123–205 MPa, and a yield strength within the range of 48–116 MPa.

8. An alloy material as claimed in claim 7, further comprising at least one of copper and zinc each in a range of 0.2 to 2.5 wt%.

9. An alloy material prepared by melting in an ambient atmosphere including a gas selected from the group consisting of $SF_6$, $CO_2$ and air, a mixture of:

an aluminum component in an amount of 1.5–10% by weight;

a rare earth component in an amount of less than 2% by weight;

a calcium component in an amount of 0.25–5.5% by weight; and from 77.5–98.25% by weight of magnesium, wherein said alloy material has a creep rate within the range of 1.55 and $2.36\times10^{-4}$/hr.

10. An alloy material as claimed in claim 9, prepared by further melting at least one of copper and zinc each in a range of 0.2 to 2.5 wt%.

11. An alloy material as claimed in claim 9, wherein said alloy has an elongation within the range of 2.9 and 15%.

12. An alloy material as claimed in claim 11, prepared by further melting at least one of copper and zinc each in a range of 0.2–to 2.5 wt%.

13. An alloy material as claimed in claim 9, wherein said alloy has a tensile strength within the range of 123–205 MPa.

14. An alloy material as claimed in claim 9, wherein said alloy has a yield strength within the range of 48–116 MPa.

15. An alloy material as claimed in claim 9, wherein said alloy has an elongation within the range of 2.9 and 15%, a tensile strength within the range of 123–205 MPa, and a yield strength within the range of 48–116 MPa.

16. An alloy material as claimed in claim 15, prepared by further melting at least one of copper and zinc each in a range of 0.2 to 2.5 wt%.

17. A magnesium containing metallic alloy material consisting essentially of:

an aluminum component in an amount of from 1.5–10% by weight;

a rare earth component in an amount of less than 2% by weight;

a calcium component in an amount of from 0.25–5.5% by weight; and from 77.5–98.25% by weight of magnesium, wherein said alloy has a creep rate within the range of 1.55 and $2.36\times10^{-4}$/hr.

18. An alloy as claimed in claim 17, further comprising at least one of a copper component and a zinc component each in a range of from 0.2–2.5% by weight.

19. An alloy material as claimed in claim 17, wherein said alloy has an elongation within the range of 2.9 and 15%, a tensile strength within the range of 123–205 MPa, and a yield strength within the range of 48–116 MPa.

20. An alloy as claimed in claim 19, further comprising at least one of a copper component and a zinc component each in a range of from 0.2–2.5% by weight.

* * * * *